US011143419B2

(12) United States Patent
Seki et al.

(10) Patent No.: US 11,143,419 B2
(45) Date of Patent: Oct. 12, 2021

(54) AIR-CONDITIONING APPARATUS

(71) Applicant: Mitsubishi Electric Corporation, Tokyo (JP)

(72) Inventors: Yusaku Seki, Tokyo (JP); Tetsuya Tazawa, Tokyo (JP); Keisuke Tomomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 160 days.

(21) Appl. No.: 16/469,200

(22) PCT Filed: Feb. 23, 2017

(86) PCT No.: PCT/JP2017/006890
§ 371 (c)(1),
(2) Date: Jun. 13, 2019

(87) PCT Pub. No.: WO2018/154681
PCT Pub. Date: Aug. 30, 2018

(65) Prior Publication Data
US 2019/0368751 A1 Dec. 5, 2019

(51) Int. Cl.
*F24F 13/20* (2006.01)
*F24F 1/0047* (2019.01)
(Continued)

(52) U.S. Cl.
CPC ..... *F24F 1/0047* (2019.02); *F24F 1/0007* (2013.01); *F24F 1/0011* (2013.01);
(Continued)

(58) Field of Classification Search
CPC ..... F24F 1/0047; F24F 1/0317; F24F 13/06; F24F 13/068; F24F 13/082; F24F 13/084; F24F 7/10
(Continued)

(56) References Cited

U.S. PATENT DOCUMENTS 6,354,936 B1 * 3/2002 Noh ..... F24F 1/027 16/361
2015/0093983 A1 * 4/2015 Jeong ..... F24F 1/0047 454/248
2019/0346171 A1 * 11/2019 Tagaya ..... F24F 1/0073

FOREIGN PATENT DOCUMENTS

JP H08-144618 A 6/1996
JP H08-285315 A 11/1996
(Continued)

OTHER PUBLICATIONS

International Search Report of the International Searching Authority dated May 16, 2017 for the corresponding international application No. PCT/JP2017/006890 (and English translation).
(Continued)

*Primary Examiner* — Vivek K Shirsat
*Assistant Examiner* — Ko-Wei Lin
(74) *Attorney, Agent, or Firm* — Posz Law Group, PLC

(57) ABSTRACT

An air-conditioning apparatus includes a body, a decorative panel attached to a lower surface of the body defining a lower surface of the air-conditioning apparatus, an air-inlet grille that can rotate to open and close and is attached to an air inlet of the decorative panel, and a shaft disposed on the decorative panel. The shaft is movable along an axis of rotation of the air-inlet grille. The shaft includes a shaft body, a pivot protruding from one end face of the shaft body in a moving direction of the shaft, and a rib extending parallel to the pivot. The air-inlet grille has a mating portion into which the pivot is inserted to support rotation of the air-inlet grille. The pivot engages the air-inlet grille at a first limit of a movable range of the shaft. The rib engages the decorative panel while the pivot is fitted in the mating portion.

9 Claims, 8 Drawing Sheets

(51) Int. Cl.

| | |
|---|---|
| ***F24F 1/0007*** | (2019.01) |
| ***F24F 1/0011*** | (2019.01) |
| ***F24F 13/068*** | (2006.01) |
| ***F24F 13/08*** | (2006.01) |
| *F24F 13/06* | (2006.01) |

(52) U.S. Cl.
CPC ..... *F24F 13/068* (2013.01); *F24F 13/084* (2013.01); *F24F 2013/0608* (2013.01)

(58) Field of Classification Search
USPC ..... 454/292, 296
See application file for complete search history.

(56) References Cited

FOREIGN PATENT DOCUMENTS

| | | |
|---|---|---|
| JP | H09-196407 A | 7/1997 |
| JP | H10-205806 A | 8/1998 |
| KR | 10-1280371 B1 | 7/2013 |

OTHER PUBLICATIONS

Examination Report dated Sep. 14, 2020 issued in corresponding IN patent application No. 201947031064.

* cited by examiner

AIR-CONDITIONING APPARATUS

CROSS REFERENCE TO RELATED APPLICATION

This application is a U.S. national stage application of PCT/JP2017/006890 filed on Feb. 23, 2017, the contents of which are incorporated herein by reference.

TECHNICAL FIELD

The present invention relates to an air-conditioning apparatus, and in particular, relates to a structure around the axis of rotation of an air-inlet grille that can rotate to open and close.

BACKGROUND ART

A typical ceiling concealed air-conditioning apparatus includes a box-shaped air-conditioning-apparatus body (hereinafter, referred to as a "body"), which contains a fan and a heat exchanger and is concealed in and fixed to a ceiling. The air-conditioning apparatus further includes a decorative panel fixed to a surface of the body that is exposed in an indoor space to cover the whole of the surface. The decorative panel has an opening to which an air-inlet grille is attached. The attached air-inlet grille is rotatable relative to the decorative panel and is detachable from and attachable to the panel because such an air-conditioning apparatus needs to allow access from the indoor space to the inside of the body for maintenance.

For example, a ceiling concealed air-conditioning apparatus disclosed in Patent Literature 1 includes shafts attached to a decorative panel. The shafts each include a pivot fitted to the decorative panel. This arrangement allows an air-inlet grille attached to the decorative panel so that it can rotate relative to, and be detachable to and from the decorative panel.

CITATION LIST

Patent Literature

Patent Literature 1: Japanese Unexamined Patent Application Publication No. 10-205806

SUMMARY OF INVENTION

Technical Problem

In the air-conditioning apparatus disclosed in Patent Literature 1, after attachment of the air-inlet grille to the decorative panel, the shafts fitted in the air-inlet grille may be inclined due to the weight of the air-inlet grille. Since the air-inlet grille rotates about the pivot of each shaft, the inclination of the shaft causes displacement of the axis of rotation. Disadvantageously, the displacement hinders smooth rotation of the air-inlet grille.

The present invention has been made to overcome the above-described disadvantages, and aims to provide an air-conditioning apparatus including an air-inlet grille that can rotate relative to and be detachable to and from a decorative panel such that the air-inlet grille is smoothly rotatable.

Solution to Problem

An air-conditioning apparatus according to an embodiment of the present invention includes a body; a decorative panel attached to a lower surface of the body defining a lower surface of the air-conditioning apparatus; an air-inlet grille that is attached to an air inlet of the decorative panel and can rotate to open and close; and a shaft disposed on the decorative panel, the shaft being movable along an axis of rotation of the air-inlet grille, wherein the shaft includes a shaft body, a pivot protruding from one end face of the shaft body in a moving direction of the shaft, and a rib extending parallel to the pivot, wherein the air-inlet grille has a mating hole into which the pivot is inserted to support rotation of the air-inlet grille, wherein the pivot is fitted in the mating hole at a first limit of a movable range of the shaft, and wherein the rib engages the decorative panel while the pivot is fitted in the mating hole.

Advantageous Effects of Invention

Such a configuration of the air-conditioning apparatus according to the embodiment of the present invention enables the air-inlet grille supported so that it can rotate and be detachable to and from the decorative panel. Furthermore, this configuration reduces or eliminates displacement of the axis of rotation of the air-inlet grille and thus enables smooth rotation of the air-inlet grille. The smooth rotation of the air-inlet grille allows a smooth operation of opening the air-inlet grille for maintenance of the body of the air-conditioning apparatus. This reduces or eliminates accidental falling of the air-inlet grille during the operation.

DESCRIPTION OF EMBODIMENTS

Figure 1:
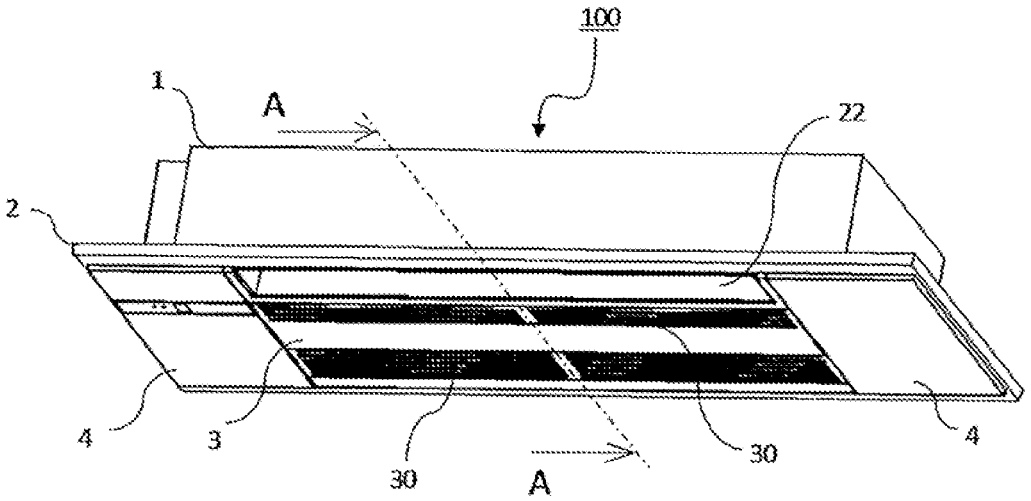
FIG. 1 is a perspective view of an air-conditioning apparatus according to Embodiment 1 of the present invention.

An embodiment of the present invention will be described below with reference to the drawings. Note that devices and components designated by the same reference signs in the drawings are the same devices and components or equivalents. This note applies to the entire description herein. Furthermore, note that the forms of components described herein are intended to be illustrative only and the scope of the present invention is not limited only to the description herein. In particular, a combination of components is not intended to be limited only to that in each embodiment. A component in one embodiment can be used in another embodiment. Furthermore, note that the relationship between the sizes of the components in the drawings may differ from that of actual ones.

Embodiment 1

Configuration of Air-Conditioning Apparatus 100

FIG. 1 is a perspective view of an air-conditioning apparatus according to Embodiment 1 of the present invention. An air-conditioning apparatus 100 illustrated in FIG. 1 is of a ceiling concealed type, and includes a body 1 of the air-conditioning apparatus 100, a decorative panel 2, and an openable air-inlet grille 3. The decorative panel 2, which defines a lower surface of the air-conditioning apparatus 100, is attached to a lower surface of the body 1 of the air-conditioning apparatus 100. The decorative panel 2 has, in its central part, an air inlet 21 because it is necessary to take air in an indoor space into the body 1. The air inlet 21 is covered with the air-inlet grille 3. Side panels 4 are arranged on opposite sides, or right and left sides, of the air-inlet grille 3. Furthermore, an air outlet 22 through which the air in the body 1 is sent to the indoor space is provided along a long side of the decorative panel 2. The air-inlet grille 3 has a plurality of holes 30 because the air-inlet grille 3 has to allow the air in the indoor space to pass therethrough when the air is taken into the body 1.

Figure 2:
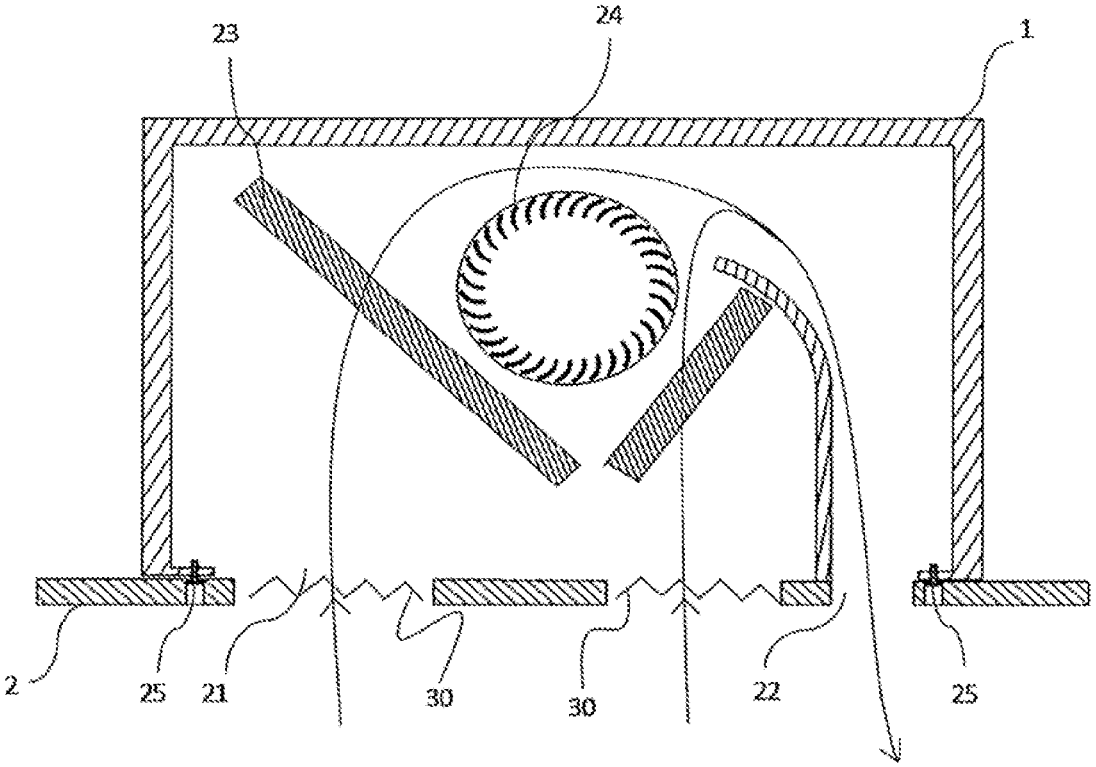
FIG. 2 is a schematic cross-sectional view of the air-conditioning apparatus taken along line A-A in FIG. 1.

FIG. 2 is a schematic cross-sectional view of the air-conditioning apparatus 100 taken along line A-A in FIG. 1. Inside the body of the air-conditioning apparatus 100, a heat exchanger 23 and a fan 24 are arranged above the air inlet 21. Rotation of the fan 24 causes the air in the indoor space to be drawn into the body 1 through the air inlet 21. The air drawn into the body 1 through the air inlet 21 experiences heat exchange while passing through the heat exchanger 23 and is then blown to the indoor space through the air outlet 22.

Figure 3:
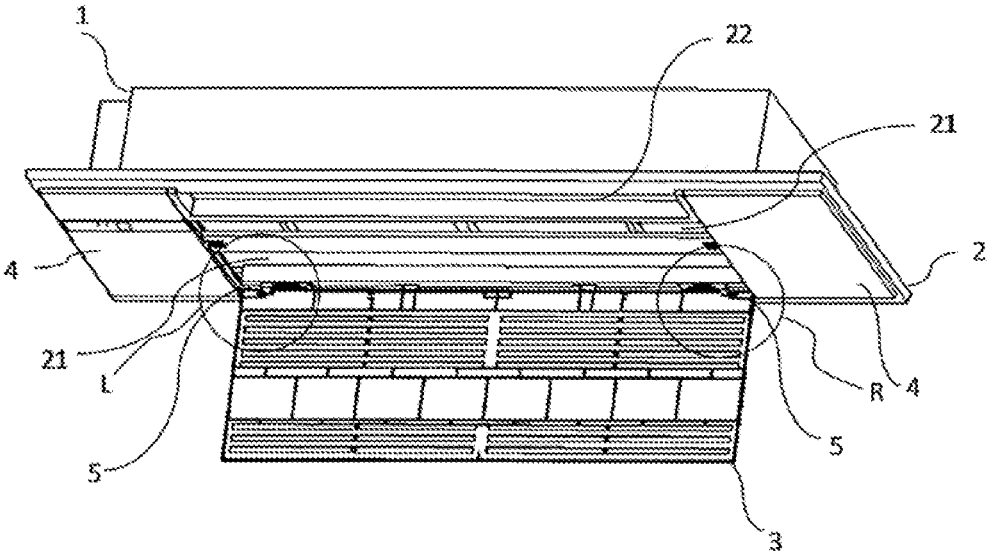
FIG. 3 is a perspective view of the air-conditioning apparatus of FIG. 1 when an air-inlet grille is open.

FIG. 3 is a perspective view of the air-conditioning apparatus 100 of FIG. 1 when the air-inlet grille 3 is open. To perform maintenance of the inside of the body 1 of the air-conditioning apparatus 100 installed in a ceiling, the inside of the body 1 has to be exposed in the indoor space. The decorative panel 2 is fixed to the body 1 with screws 25 such that the decorative panel 2 is removable from the body 1. Although the inside of the body 1 can be exposed in the indoor space by removing the decorative panel 2, the inside of the body 1 of the air-conditioning apparatus 100 can be exposed in the indoor space by opening the air-inlet grille 3, which is attached to the decorative panel 2 so that it can be opened. This allows maintenance of the air-conditioning apparatus 100 without removal of the decorative panel 2. Furthermore, the air-inlet grille 3 is attached to the decorative panel 2 with shafts 5 attached to the decorative panel 2 such that the air-inlet grille 3 can be opened. Two shafts 5 extend adjacent to another long side of the decorative panel 2 and are arranged symmetrically with respect to central part of the air inlet 21.

Figure 4:
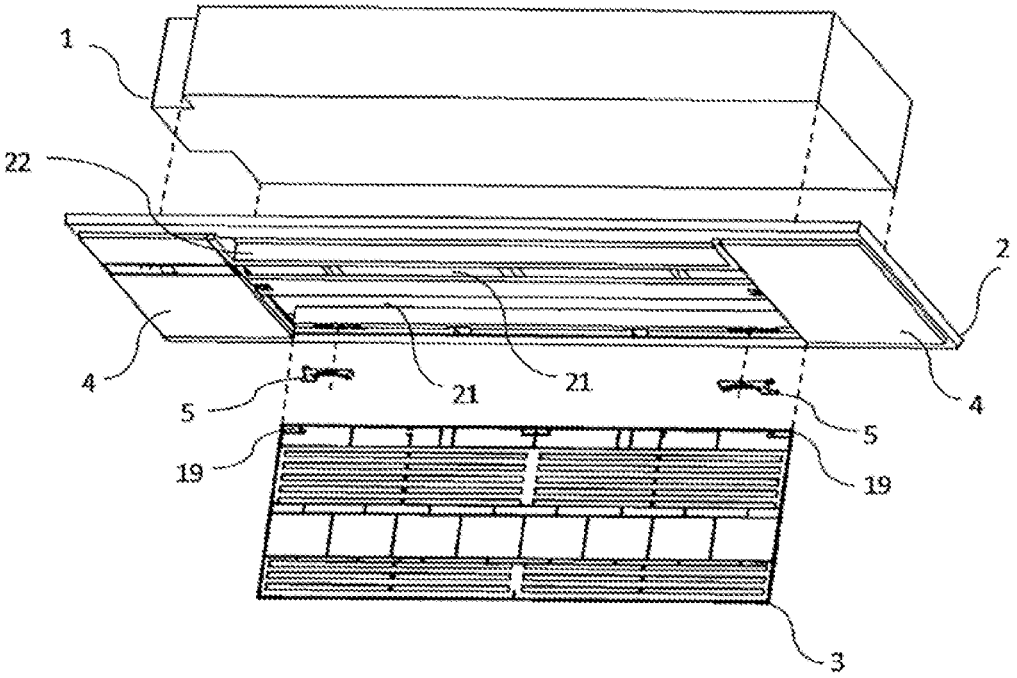
FIG. 4 is an exploded perspective view of the air-conditioning apparatus according to Embodiment 1 of the present invention.

FIG. 4 is an exploded perspective view of the air-conditioning apparatus 100 according to Embodiment 1 of the present invention. To install the air-conditioning apparatus 100 in the ceiling, the body 1 is first attached to the ceiling. Then, the decorative panel 2 with the air-inlet grille 3 and the side panels 4 is attached to a portion of the body 1 that faces the indoor space. After that, the air-inlet grille 3 is attached to the decorative panel 2. Before attachment of the air-inlet grille 3, the shafts 5 are attached to the decorative panel 2. After that, the air-inlet grille 3 is attached to the decorative panel 2 with the shafts 5.

Figure 5:
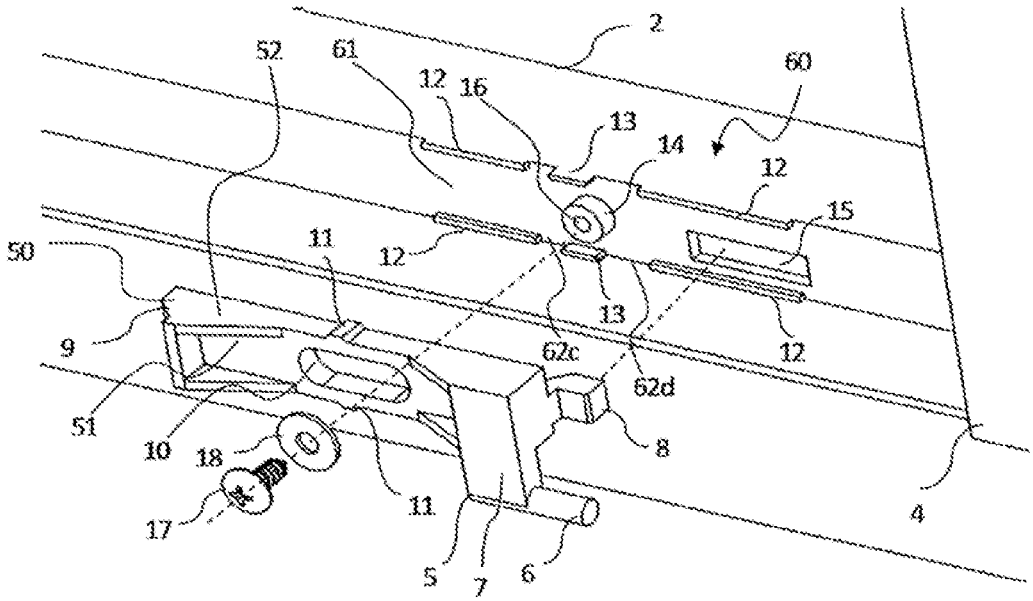
FIG. 5 is an exploded perspective view illustrating a shaft included in the air-conditioning apparatus according to Embodiment 1 of the present invention.
Figure 6:
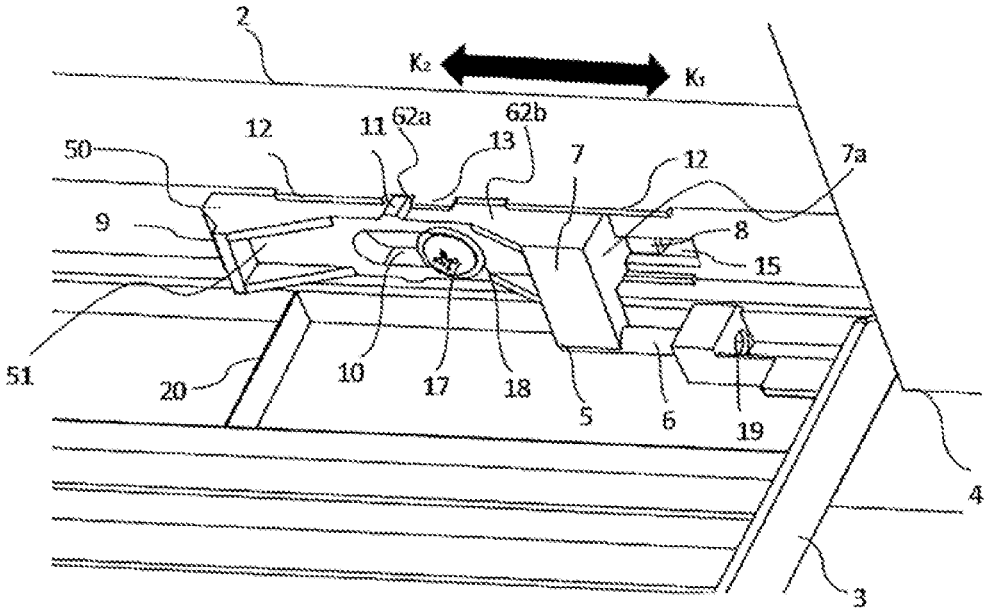
FIG. 6 is an enlarged view of part R in FIG. 3.
Figure 7:
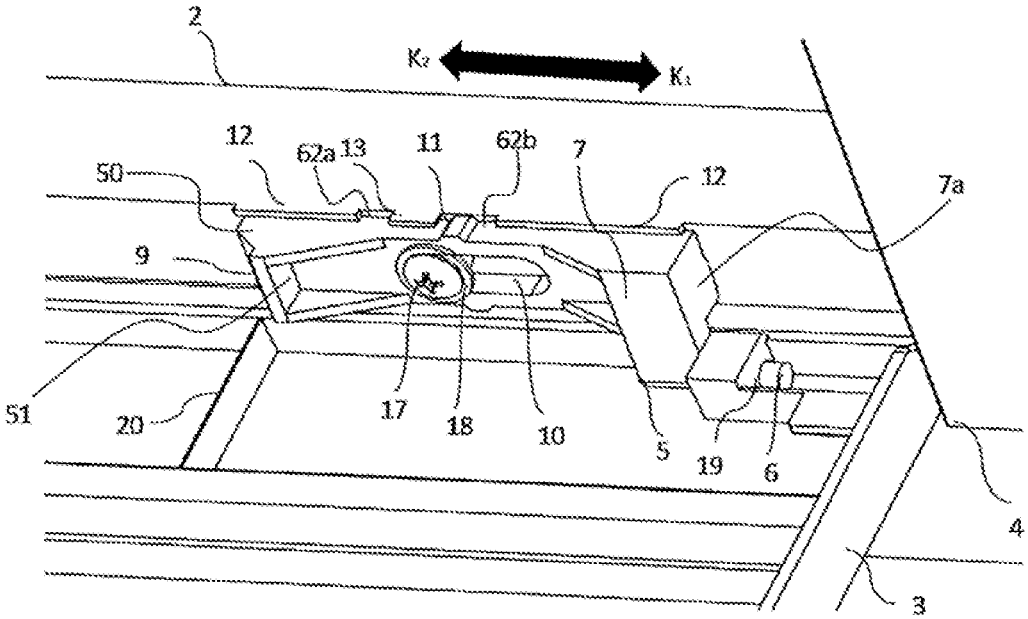
FIG. 7 is an enlarged view of the part R in FIG. 3.
Figure 8:
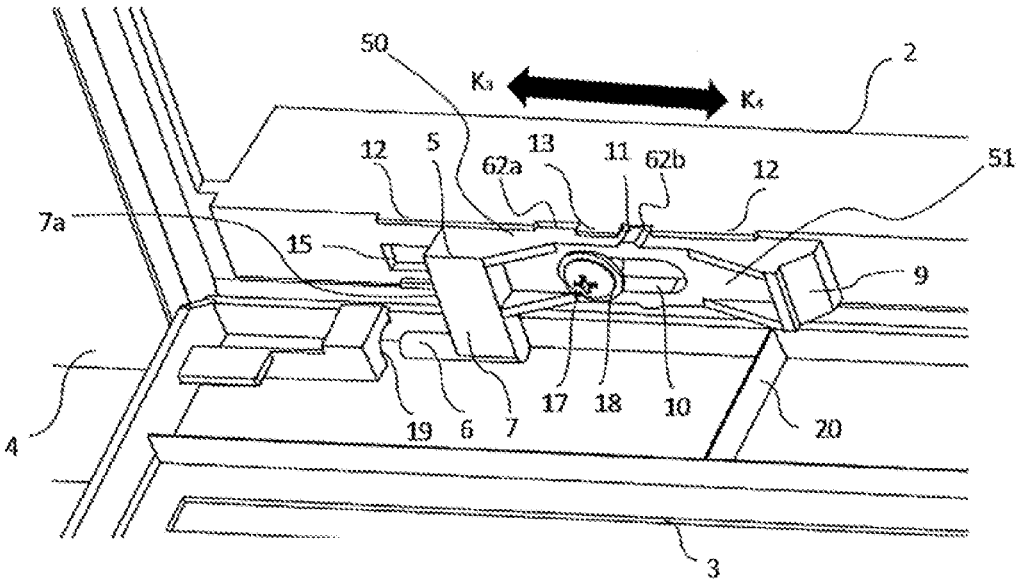
FIG. 8 is an enlarged view of part L in FIG. 3.
Figure 9:
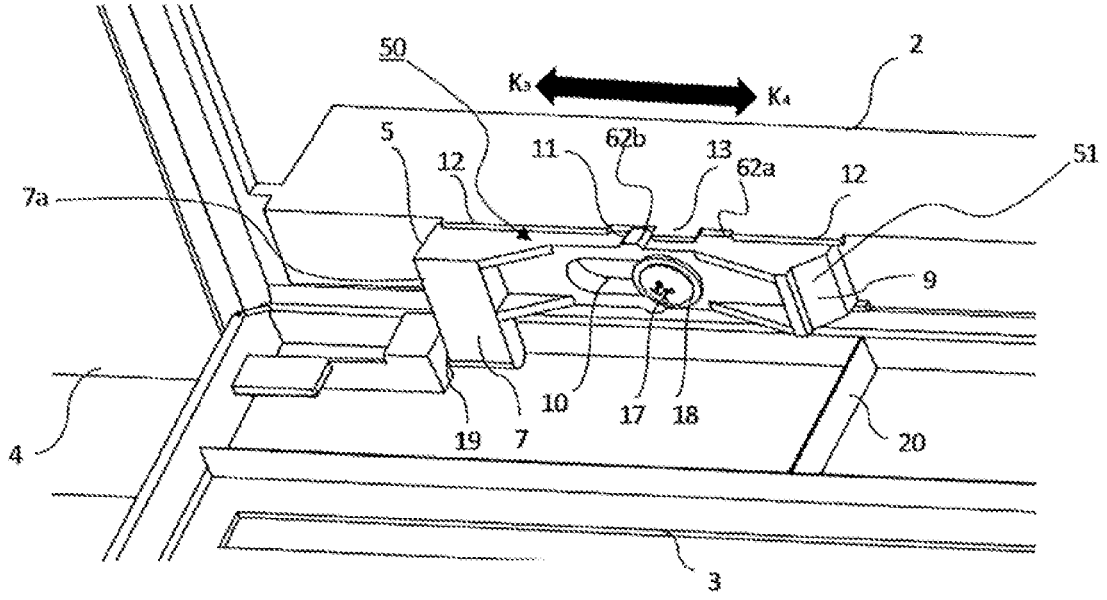
FIG. 9 is an enlarged view of the part L in FIG. 3.

FIG. 5 is an exploded perspective view illustrating the shaft 5 of the air-conditioning apparatus 100 according to Embodiment 1 of the present invention. FIGS. 6 and 7 are enlarged views of part R in FIG. 3. FIGS. 8 and 9 are enlarged views of part L in FIG. 3. FIGS. 6 and 8 illustrate the shafts 5 located at disengaged positions, at which each shaft disengages the air-inlet grille 3. FIGS. 7 and 9 illustrate the shafts 5 located at engaged positions, at which each shaft engages the air-inlet grille 3. Each shaft 5 is long in a moving direction in which the shaft 5 is moved, and includes a cylindrical pivot 6 on one end face of the shaft in a longitudinal direction of the shaft. The pivot 6 is provided on a pivot support 7 included in end part of a shaft body 51 of the shaft 5, and protrudes in the longitudinal direction of the shaft 5. A cuboid rib 8 protrudes from an end of the shaft body 51 adjacent to the pivot 6 and extends in the longitudinal direction of the shaft. The rib 8 is located closer to the decorative panel 2 than the pivot 6. When the shaft 5 is attached to the decorative panel 2, the rib 8 is fitted in an opening 15 of the decorative panel 2. The other end of the shaft 5 in the longitudinal direction, or the end thereof remote from the pivot 6 and the rib 8, has a slope 9. The shaft body 51 has, in its central part, a hole 10. The shaft 5 further includes shaft protrusion 11 protruding from a central part of each of faces, each serving as a long side of the shaft 5.

The decorative panel 2 includes two retainers 60 for the shafts 5 such that the retainers are arranged at two adjacent corners of four corners of the air inlet 21. Each retainer 60 has an attachment area 61 for the shaft 5. The attachment area 61 has a cylindrical boss 14 protruding therefrom. The boss 14 has, in its central part, a screw hole 16. The attachment area 61 is long in the moving direction of the shaft 5 to fit the shaft body 50 of the shaft 5. Rails 12 extend in a longitudinal direction of the attachment area 61. The rails 12 are arranged on opposite sides of the attachment area 61. In other words, the rails 12 are arranged in a sliding direction of the shaft 5 to guide the shaft 5 such that the shaft 5 moves straight when sliding.

Each rail 12 has recesses in its central part in a longitudinal direction of the rail and includes a panel protrusion 13 disposed between the recesses. The recesses on both sides of the panel protrusion 13 of the rail 12 serve as clearance recesses, indicated at 62*a* to 62*d*, such that each shaft protrusion 11 of the shaft 5 is not pressed against the rail 12 and the panel protrusion 13 while the shaft 5 is attached to the decorative panel 2. Referring to FIG. 6, while the pivot 6 is located out of a mating hole 19, the shaft protrusion 11 is located in the recess 62*a*. Although the shaft 5 is movable in a direction of arrow $K_1$, the shaft protrusion 11 needs to move beyond the panel protrusion 13, which is located on a path along which the shaft protrusion 11 moves. This arrangement enables the shaft 5 to be kept at the disengaged position where the pivot 6 is located out of the mating hole 19. This facilitates attachment of the air-inlet grille 3 because the air-inlet grille 3 does not come into contact with the pivot 6 when attached. In FIG. 6, the shaft protrusion 11 on the opposite face is in the same state as that of the shaft protrusion 11 facing the viewer in FIG. 6. As illustrated in FIG. 7, while the pivot 6 is fitted in the mating hole 19, the shaft protrusion 11 is located in the recess 62*b*. In such a state, although the shaft 5 is movable in a direction of arrow $K_2$, the shaft protrusion 11 needs to move beyond the panel protrusion 13. This arrangement keeps the pivot 6 fitted in the mating hole 19 from being readily removed from the hole. Thus, the air-inlet grille 3 is unlikely to accidentally fall. Furthermore, this arrangement allows a definite determination that the pivot 6 is fitted in the mating hole 19, thus ensuring attachment of the air-inlet grille 3.

In addition, each attachment area 61 has the opening 15, in which the rib 8 fits when the shaft 5 is attached to the decorative panel 2. To attach the shaft 5 to the decorative panel 2, the rib 8 of the shaft 5 is positioned at and inserted into the opening 15 of the decorative panel 2, and the boss 14 of the decorative panel 2 is inserted into the hole 10 of the shaft 5. The opening 15 of the decorative panel 2 is sized for a movable range of the shaft 5. A washer 18 is fastened to a top surface of the boss 14 extending through the hole 10 of the shaft 5 with a screw 17, thereby attaching the shaft 5 to the boss 14 such that the shaft is not disconnected from the boss 14. Thus, the shaft 5 is slidable in the longitudinal direction. The boss 14 of the decorative panel 2 is set to have a height slightly greater than the thickness of the hole 10 of the shaft 5 by, for example, approximately 0.5 mm. If the boss 14 was lower than the hole of the shaft 5, the shaft 5 would be fixed and could not slide. If the boss 14 was much higher than the hole of the shaft 5, the shaft 5 and the attachment area 61 of the decorative panel 2 would have a too large gap therebetween.

The air-inlet grille 3 has the mating holes 19 to fit the pivot 6 of the shaft 5. The mating holes 19 are arranged at two adjacent corners of four corners of the grille. The air-inlet grille 3 is rotatable about the axis of each mating hole 19. To attach the air-inlet grille 3 to the decorative panel 2, the two shafts 5 attached to the parts R and L in FIG. 3 are moved toward each other. The mating holes 19 of the air-inlet grille 3 are axially aligned with the pivots 6 of the shafts 5, the two shafts 5 are moved away from each other, and the pivots 6 of the shafts 5 are fitted into the mating holes 19. As illustrated in FIGS. 6 and 7, the pivot 6 of the shaft 5 in the part R in FIG. 3 is fitted into the mating hole 19 when the shaft is moved in the direction of the arrow $K_1$, and is removed from the mating hole 19 when the shaft is moved in the direction of the arrow $K_2$. As illustrated in FIGS. 8 and 9, the pivot 6 of the shaft 5 in the part L is fitted into the mating hole 19 when the shaft is moved in a direction of arrow $K_3$, and is removed from the mating hole 19 when the shaft is moved in a direction of arrow $K_4$. Fitting the pivots 6 of the shafts 5 into the mating holes 19, arranged adjacent to opposite ends of the air-inlet grille 3 in the longitudinal direction, allows rotation of the air-inlet grille 3 about the axis of the mating holes 19, thus providing openable attachment of the air-inlet grille 3.

Figure 10:
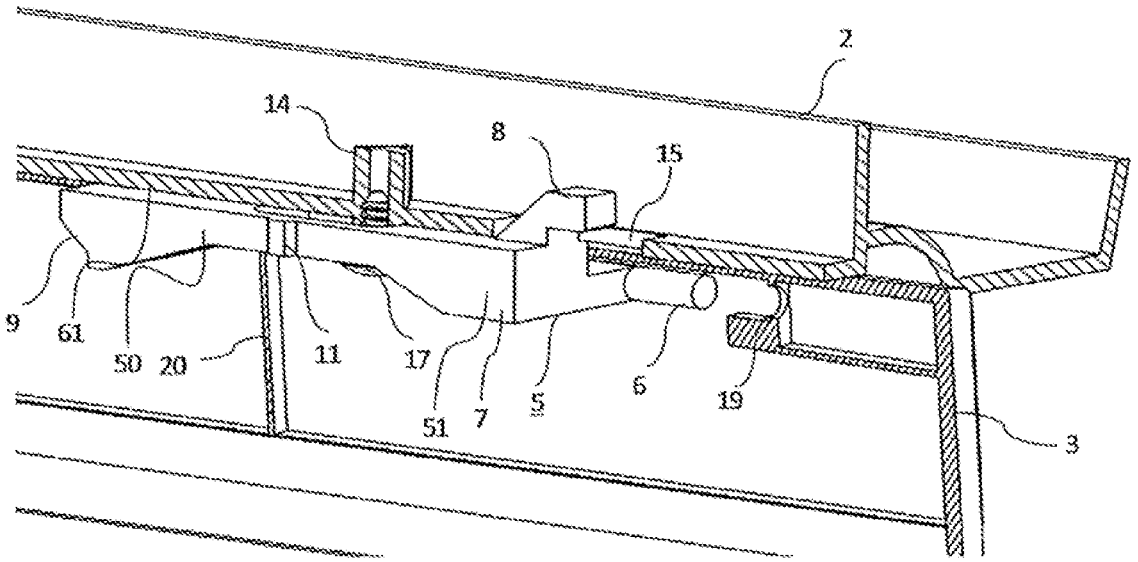
FIG. 10 is a diagram illustrating a section of the air-conditioning apparatus of FIG. 6 taken in a direction perpendicular to an attachment area to which the shaft is attached.
Figure 11:
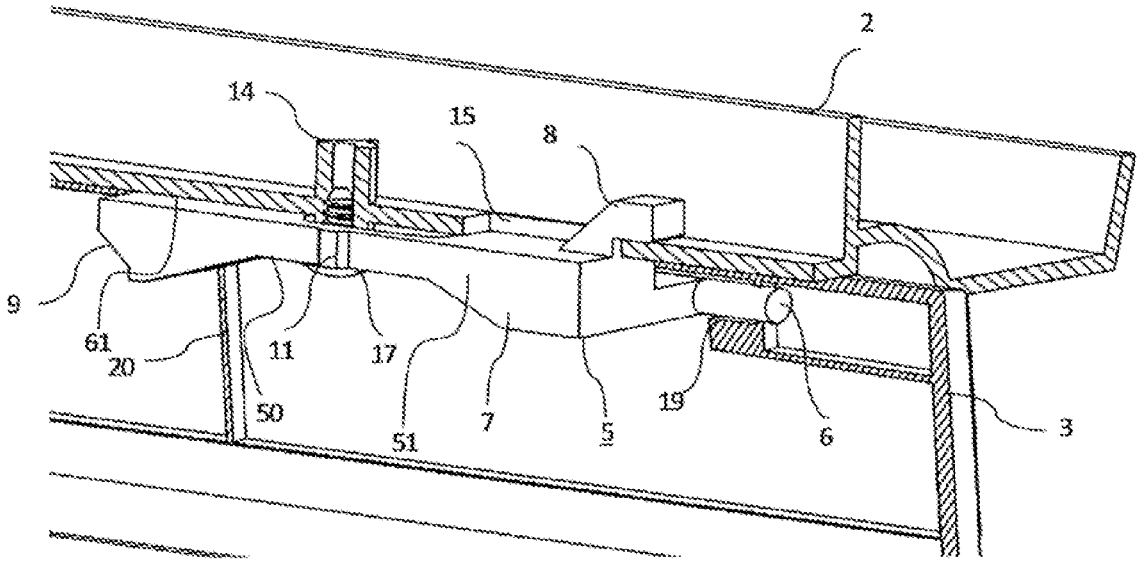
FIG. 11 is a diagram illustrating a section of the air-conditioning apparatus of FIG. 7 taken in the direction perpendicular to the attachment area to which the shaft is attached.

FIG. 10 is a diagram illustrating a section of the air-conditioning apparatus 100 of FIG. 6 taken in a direction perpendicular to the attachment area 61 for the shaft 5. FIG. 11 is a diagram illustrating a section of the air-conditioning apparatus 100 of FIG. 7 taken in the direction perpendicular to the attachment area 61 for the shaft 5. The rib 8 of the shaft 5 protrudes in the same direction as the direction in which the pivot 6 extends, and is parallel to the pivot 6. The rib 8 is caught by the decorative panel 2 when the pivot 6 is fitted into the mating hole 19. The rib 8 has a size sufficient to provide rigidity and strength necessary to support the air-inlet grille 3. The size is set so that under conditions where the rib 8 receives the weight of the air-inlet grille 3, part of the shaft that is located between the rib 8 and the pivot 6 does not bend to incline the pivot 6. The pivot 6 protrudes from the one end face of the shaft body 50 in the longitudinal direction and extends in the longitudinal direction of the shaft body 50, such that the air-inlet grille 3 does not interfere with the shaft 5 when attached to the shaft 5.

As illustrated in FIGS. 10 and 11, when the pivot 6 of the shaft 5 is fitted into the mating hole 19, the rib 8 of the shaft 5 is caught by the decorative panel 2. This arrangement prevents the shaft 5 from being inclined due to the weight of the air-inlet grille 3 when the pivot 6 receives the weight of the air-inlet grille 3. Since the pivot 6 is not inclined, the axis of rotation of the air-inlet grille 3 is not displaced when the air-inlet grille 3 is opened or closed. This allows smooth rotation of the air-inlet grille 3.

Figure 12:
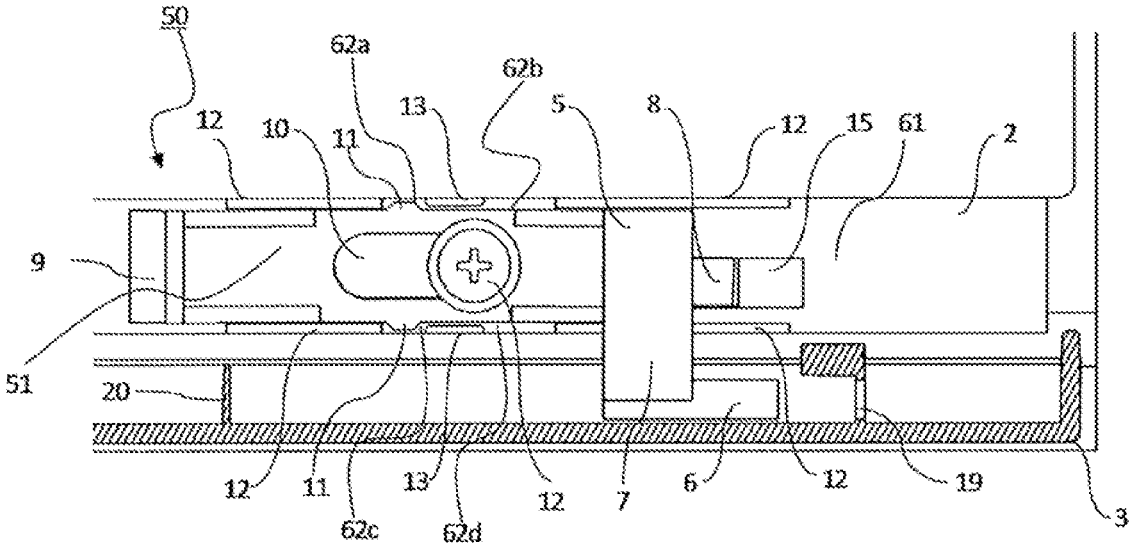
FIG. 12 is a diagram illustrating a section of the air-conditioning apparatus of FIG. 6 taken along the axis of a mating hole and parallel to the attachment area.
Figure 13:
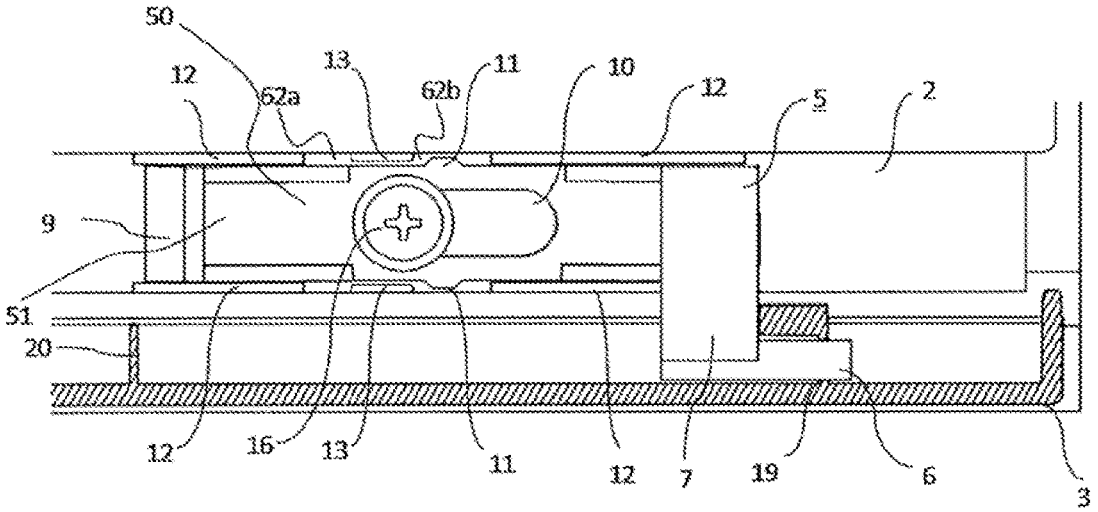
FIG. 13 is a diagram illustrating a section of the air-conditioning apparatus of FIG. 7 taken along the axis of the mating hole and parallel to the attachment area.

FIG. 12 is a diagram illustrating a section of the air-conditioning apparatus 100 of FIG. 6 taken along the axis of the mating hole 19 and parallel to the attachment area 61. FIG. 13 is a diagram illustrating a section of the air-conditioning apparatus 100 of FIG. 7 taken along the axis of the mating hole 19 and parallel to the attachment area 61. As illustrated in FIGS. 12 and 13, the shaft protrusions 11 of the shaft 5 are arranged to interfere with the panel protrusions 13 included in the retainer 60 of the decorative panel 2, when the shaft 5 slides. The movement of the shaft protrusions 11 of the shaft 5 beyond the panel protrusions 13 of the decorative panel 2 results in either the engaged position of the shaft 5 or the disengaged position thereof. This allows a definite determination on whether the pivot 6 is fitted in the mating hole 19.

Figure 14:
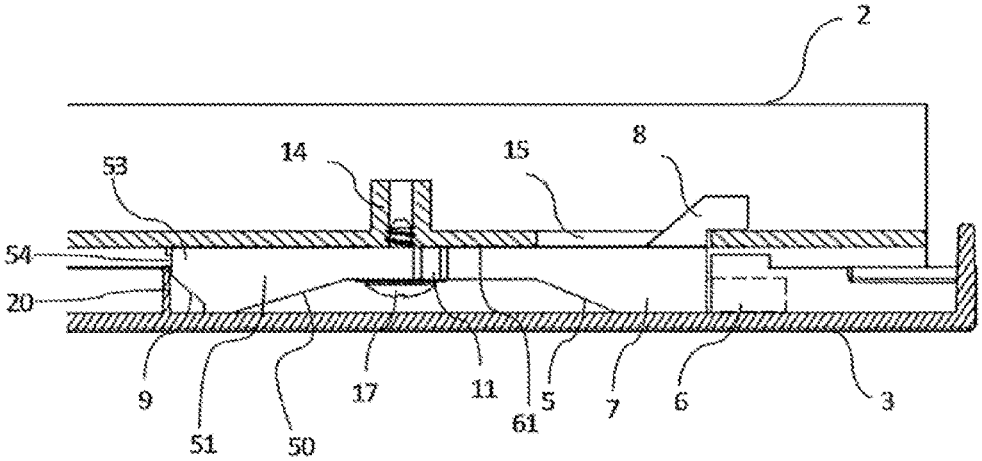
FIG. 14 is a diagram illustrating a section of the air-conditioning apparatus of FIG. 6 taken in a shaft moving direction when the air-inlet grille is closed.
Figure 15:
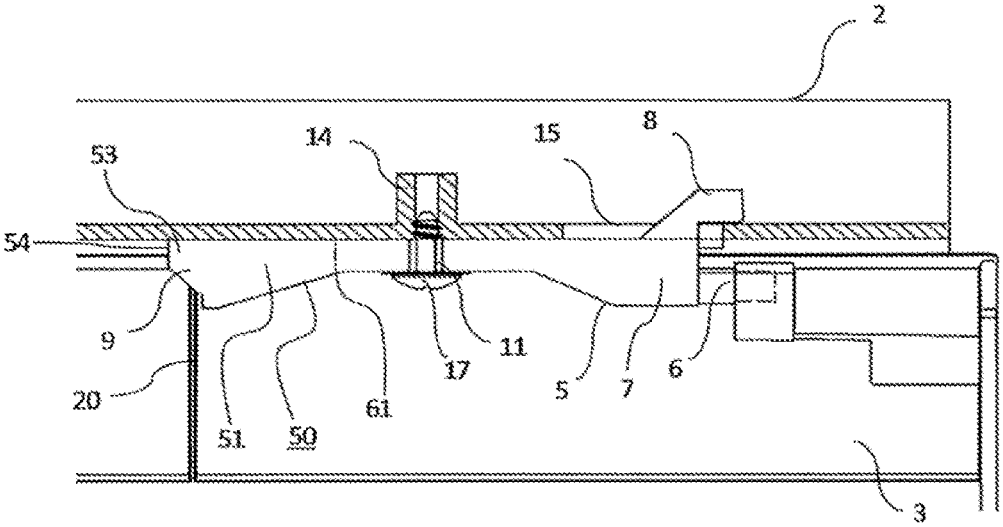
FIG. 15 is a diagram illustrating a section of the apparatus taken in the shaft moving direction when the air-inlet grille in FIG. 14 is open.
Figure 16:
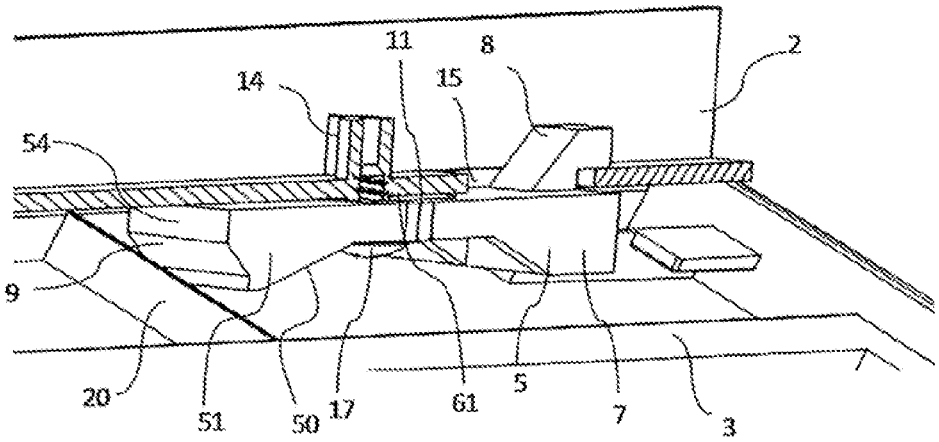
FIG. 16 is a perspective view of the apparatus when the air-inlet grille is shifted from a state in FIG. 15 to a closed position and a movement limiter is in contact with a slope of the shaft.

FIG. 14 is a diagram illustrating a section of the air-conditioning apparatus 100 of FIG. 6 taken in the moving direction of the shaft when the air-inlet grille 3 is closed. FIG. 15 is a diagram illustrating a section of the apparatus taken in the moving direction of the shaft when the air-inlet grille 3 in FIG. 14 is open. FIG. 16 is a perspective view of the apparatus when the air-inlet grille 3 is shifted from a state of FIG. 15 to a closed position and a movement limiter 20 is in contact with the slope 9 of the shaft 5. FIGS. 14, 15, and 16 illustrate the sections taken along the axis of the boss 14 provided on the attachment area 61 for the shaft 5. While the air-inlet grille 3 is open, the shaft 5 is movable from the engaged position where the pivot 6 is fitted in the mating hole 19 to the disengaged position where the pivot 6 is located out of the mating hole 19. While the air-inlet grille 3 is closed, however, the movement limiter 20 provided on the air-inlet grille 3 is located beside the end, indicated at 53, of the shaft 5 remote from the pivot 6. While the air-inlet grille 3 is closed, the movement limiter 20 is located on a path along which the shaft 5 moves and is positioned across a predetermined gap from the end 53 of the shaft 5. The gap between the end 53 of the shaft 5 and the movement limiter 20 is set as small as possible. The gap is set to at least a distance of insertion of the pivot 6 into the mating hole 19. Specifically, a distance between the movement limiter 20 of the air-inlet grille 3 and the mating hole 19 is set shorter than a distance between an abutment face 54 of the shaft body 50 and the tip of the pivot 6. The abutment face 54 is a face to come into contact with the movement limiter 20 when the shaft 5 moves.

Such a configuration makes the pivot 6 of the shaft 5 unlikely to move out of the mating hole 19 while the air-inlet grille 3 is closed. Consequently, the air-inlet grille 3 can be prevented from falling from the air-conditioning apparatus 100 when any impact is applied to the air-conditioning apparatus 100.

As illustrated in FIG. 15, when the shaft 5 is incompletely inserted into the mating hole 19 and the air-inlet grille 3 is closed, the movement limiter 20 interferes with the slope 9 of the shaft 5. When the air-inlet grille 3 is moved to the closed position, the movement limiter 20 presses the slope 9 of the shaft 5, so that the pivot 6 is moved in a direction in which the pivot 6 is fitted into the mating hole 19. When the slope 9 is pressed, the pivot 6 is forced to enter the mating hole 19 of the air-inlet grille 3, and the shaft 5 is moved to a position at which the pivot 6 is firmly fitted in the mating hole 19. Such a configuration prevents the air-inlet grille 3 from being closed while the pivot 6 of the shaft 5 is incompletely inserted into the mating hole 19. This prevents the air-inlet grille 3 from falling due to accidental removal of the pivot 6 from the mating hole 19.

Advantageous Effects of Embodiment 1

(1) The air-conditioning apparatus 100 according to Embodiment 1 includes the body 1, the decorative panel 2 defining the lower surface of the body 1, the air-inlet grille 3 that can rotate to open and close and is attached to the air inlet 21 of the decorative panel 2, and the shafts 5 arranged on the decorative panel 2 such that the shafts 5 are movable along the axis of rotation of the air-inlet grille 3. Each shaft 5 includes the shaft body 50, the pivot 6 protruding from the end face, indicated at 7*a*, of the shaft body 50 in the moving direction of the shaft, and the rib 8 extending parallel to the pivot 6. The air-inlet grille 3 has the mating holes 19 through which the pivots 6 extend to support rotation of the air-inlet grille 3. Each pivot 6 is fitted in the mating hole 19 at the first limit of the movable range of the shaft 5. While the pivot 6 is fitted in the mating hole 19, the rib 8 engages the decorative panel 2.

Such a configuration reduces or eliminates the likelihood that the pivots 6 of the shafts 5 fitted in the mating holes 19 of the air-inlet grille 3 may be inclined obliquely downward due to the weight of the air-inlet grille 3. Consequently, the axis of rotation of the air-inlet grille 3 can be maintained at a proper position, thus allowing the air-inlet grille 3 to smoothly move when opened or closed.

(2) In the air-conditioning apparatus 100 according to Embodiment 1, the rib 8 of each shaft 5 has a tip located farther than base part of the pivot 6 in the moving direction of the shaft 5.

Such a configuration enables the rib 8 in proximity to the end face 7*a*, from which the pivot 6 protrudes, of the shaft body 50 to support the shaft body 50. Consequently, the shaft 5 is unlikely to bend downward when the pivot 6 receives the weight of the air-inlet grille 3, thus maintaining the normal axis of rotation of the air-inlet grille 3.

(3) In the air-conditioning apparatus 100 according to Embodiment 1, each shaft body 50 includes the shaft protrusions 11 on the faces extending in the moving direction. The decorative panel 2 includes the panel protrusions 13, each of which is located on the path along which the corresponding shaft protrusion 11 moves. Each panel protrusion 13 is located between the position of the shaft protrusion 11 at the first limit of the movable range of the shaft 5 and the position of the shaft protrusion 11 at a second limit of the movable range of the shaft 5.

Such a configuration provides a distinct difference between the engaged position of the shaft 5 where the pivot 6 is fitted in the mating hole 19 of the air-inlet grille 3 and the disengaged position of the shaft 5 where the pivot 6 is located out of the mating hole 19. Thus, an operator can readily check that the pivot 6 of each shaft 5 is fitted in the mating hole 19 of the air-inlet grille 3 upon attaching the air-inlet grille 3 to the decorative panel 2. This prevents incomplete insertion of the pivot 6 into the mating hole 19. In addition, each shaft protrusion 11 fits in the recess, or clearance between the rail 12 and the panel protrusion 13, at each of the engaged position where the pivot 6 is fitted in the mating hole 19 of the air-inlet grille 3 and the disengaged position where the pivot 6 is located out of the mating hole 19. This arrangement keeps the shaft protrusion 11 from readily moving. This prevents the air-inlet grille 3 from accidentally falling from the decorative panel 2.

(4) In the air-conditioning apparatus 100 according to Embodiment 1, each movement limiter 20 is located on the path for the shaft 5 while the air-inlet grille 3 is closed. The distance between the movement limiter 20 and the mating hole 19 is shorter than the distance between the abutment face of the shaft body 51, which comes in contact with the movement limiter 20 when the shaft 5 moves, and the tip of the pivot 6.

Such a configuration eliminates the likelihood that the shaft 5 may be shifted from the engaged position, where the pivot 6 is fitted in the mating hole 19, when any impact is applied to the air-conditioning apparatus 100 with the air-inlet grille 3 closed. This prevents the air-inlet grille 3 from falling from the decorative panel 2.

(5) In the air-conditioning apparatus 100 according to Embodiment 1, each shaft body 51 has the slope 9 sloping in such a manner that the amount of interference with the movement limiter 20 increases toward the pivot 6.

In such a configuration, if the air-inlet grille 3 is closed while the pivot 6 is incompletely fitted in the mating hole 19, the movement limiter 20 can move the shaft 5. In other words, even while the pivot 6 is incompletely fitted in the mating hole 19, the shaft is moved in the direction in which the pivot 6 is fitted into the mating hole 19 by closing the air-inlet grille 3. This eliminates the likelihood that the air-inlet grille 3 may be closed while the pivot 6 is incompletely fitted in the mating hole 19, thus preventing the air-inlet grille 3 from accidentally falling.

REFERENCE SIGNS LIST

1 body 2 decorative panel 3 air-inlet grille 4 side panel 5 shaft pivot 7 pivot support 7*a* end face 8 rib 9 slope 10 hole 11 shaft protrusion 12 rail 13 panel protrusion 14 boss 15 opening 16 screw hole 17 screw 18 washer 19 mating hole 20 movement limiter 21 air inlet 22 air outlet 23 heat exchanger 24 fan 25 screw 30 hole 50 shaft body 51 shaft body 53 end 54 abutment face 60 retainer 61 attachment area 62*a* recess 62*b* recess 62*c* recess 62*d* recess 100 air-conditioning apparatus K1 arrow K2 arrow

The invention claimed is:

1. An air-conditioning apparatus comprising:

a body;

a decorative panel attached to a lower surface of the body defining a lower surface of the air-conditioning apparatus;

an air-inlet grille that is attached to an air inlet of the decorative panel and configured to rotate around an axis of rotation to open and close the air inlet; and a shaft disposed on the decorative panel, the shaft being movable along the axis of rotation within a movable range, wherein the shaft includes a shaft body, a pivot protruding in a direction of the axis of rotation from one end face of the shaft body in a moving direction of the shaft, and a rib extending parallel to the pivot, wherein the air-inlet grille has a mating hole into which the pivot is inserted to support rotation of the air-inlet grille, wherein the pivot is fitted in the mating hole at a first limit of the movable range of the shaft, wherein the rib engages the decorative panel while the pivot is fitted in the mating hole, wherein the shaft body includes a shaft protrusion, the shaft protrusion being formed on a face of the shaft body that extends in the moving direction, wherein the decorative panel includes a panel protrusion located on a path along which the shaft protrusion moves, and wherein the panel protrusion is disposed between a position of the shaft protrusion at the first limit of the movable range of the shaft and a position of the shaft protrusion at a second limit of the movable range of the shaft.

2. The air-conditioning apparatus of claim 1, wherein the rib has a tip located farther than base part of the pivot in the moving direction of the shaft.

3. The air-conditioning apparatus of claim 1, wherein the air-inlet grille includes a movement limiter that limits movement of the shaft while the air-inlet grille is closed.

4. The air-conditioning apparatus of claim 3, wherein the movement limiter is located on a path for the shaft while the air-inlet grille is closed, and wherein a distance between the movement limiter and the mating hole is shorter than a distance between an abutment face of the shaft body that comes in contact with the movement limiter when the shaft moves and a tip of the pivot.

5. The air-conditioning apparatus of claim 3, wherein the shaft body has a slope sloping in such a manner that an amount of interference between the slope and the movement limiter increases in the direction of the pivot.

6. An air-conditioning apparatus comprising:

a body;

a decorative panel attached to a lower surface of the body defining a lower surface of the air-conditioning apparatus;

an openable air-inlet grille attached to an air inlet of the decorative panel such that the air-inlet grille is configured to rotate around an axis of rotation to open and close the air inlet; and a shaft disposed on the decorative panel, the shaft being movable along an axis of rotation within a moveable range, wherein the shaft includes a shaft body, a pivot protruding from one end face of the shaft body in a direction of the axis of rotation, and a rib extending parallel to the pivot, wherein the air-inlet grille has a mating hole into which the pivot is inserted to support rotation of the air-inlet grille, wherein the pivot is fitted in the mating hole at a first limit of the movable range of the shaft, wherein the rib engages the decorative panel while the pivot is fitted in the mating hole, and wherein the air-inlet grille includes a movement limiter that limits movement of the shaft while the air-inlet grille is closed.

7. The air-conditioning apparatus of claim 6, wherein the rib has a tip located farther than base part of the pivot in the moving direction of the shaft.

8. The air-conditioning apparatus of claim 6, wherein the movement limiter is located on a path for the shaft while the air-inlet grille is closed, and wherein a distance between the movement limiter and the mating hole is shorter than a distance between an abutment face of the shaft body that comes in contact with the movement limiter when the shaft moves and a tip of the pivot.

9. The air-conditioning apparatus of claim 6, wherein the shaft body has a slope sloping in such a manner that an amount of interference between the slope and the movement limiter increases in the direction of the pivot.

* * * * *